United States Patent [19]

Jones

[11] Patent Number: 4,861,432

[45] **Date of Patent: * Aug. 29, 1989**

[54] DUAL COMPARTMENT VACUFOIL UNIT TO ELIMINATE SECONDARY HEADBOX CHATTER

[75] Inventor: Roy Jones, Raleigh, N.C.

[73] Assignee: Huyck Corporation, Wake Forest, N.C.

[ * ] Notice: The portion of the term of this patent subsequent to Oct. 25, 2005 has been disclaimed.

[21] Appl. No.: 201,605

[22] Filed: Jun. 2, 1988

Related U.S. Application Data

[62] Division of Ser. No. 116,402, Nov. 3, 1987, Pat. No. 4,780,183.

[51] Int. Cl.[4] ..... D21F 1/48

[52] U.S. Cl. ..... 162/300; 162/304; 162/352; 162/364

[58] Field of Search ..... 162/123, 202, 132, 300, 162/301, 303, 304, 345, 351, 352, 363, 364, 374, 217

[56] References Cited

U.S. PATENT DOCUMENTS

| | | | |
|---|---|---|---|
| 3,432,385 | 8/1978 | Thorp | 162/352 |
| 3,573,159 | 3/1971 | Sepall | 162/352 |
| 3,738,911 | 9/1977 | Kienzl et al. | 162/374 |
| 3,821,077 | 6/1974 | Kaiser et al. | 162/351 |
| 4,140,578 | 2/1979 | Johnson | 162/352 |
| 4,154,645 | 5/1979 | Kankaanpää162 | 364/ |
| 4,176,005 | 11/1960 | Bubik et al. | 162/236 |
| 4,416,730 | 6/1971 | Schiel | 162/264 |
| 4,425,187 | 3/1977 | Armstrong et al. | 162/299 |
| 4,447,295 | 5/1984 | Bubik et al. | 162/352 |
| 4,544,449 | 10/1985 | Arav | 162/364 |

*Primary Examiner*—Karen Hastings
*Attorney, Agent, or Firm*—Lorusso & Loud

[57] ABSTRACT

A dual compartment vacufoil unit for making linerboard grade or other multi-layer paper comprising a dual compartment vacufoil and a forming blade and a method of using same. The dual compartment vacufoil unit is positioned beneath the forming blade, with an upstream compartment located on the upstream portion of the forming blade evacuating air through a primary paper sheet prior to application of the secondary discharge, and a downstream compartment located on the downstream portion of the forming blade. The forming blade is positioned directly beneath the secondary pulp discharge.

3 Claims, 1 Drawing Sheet

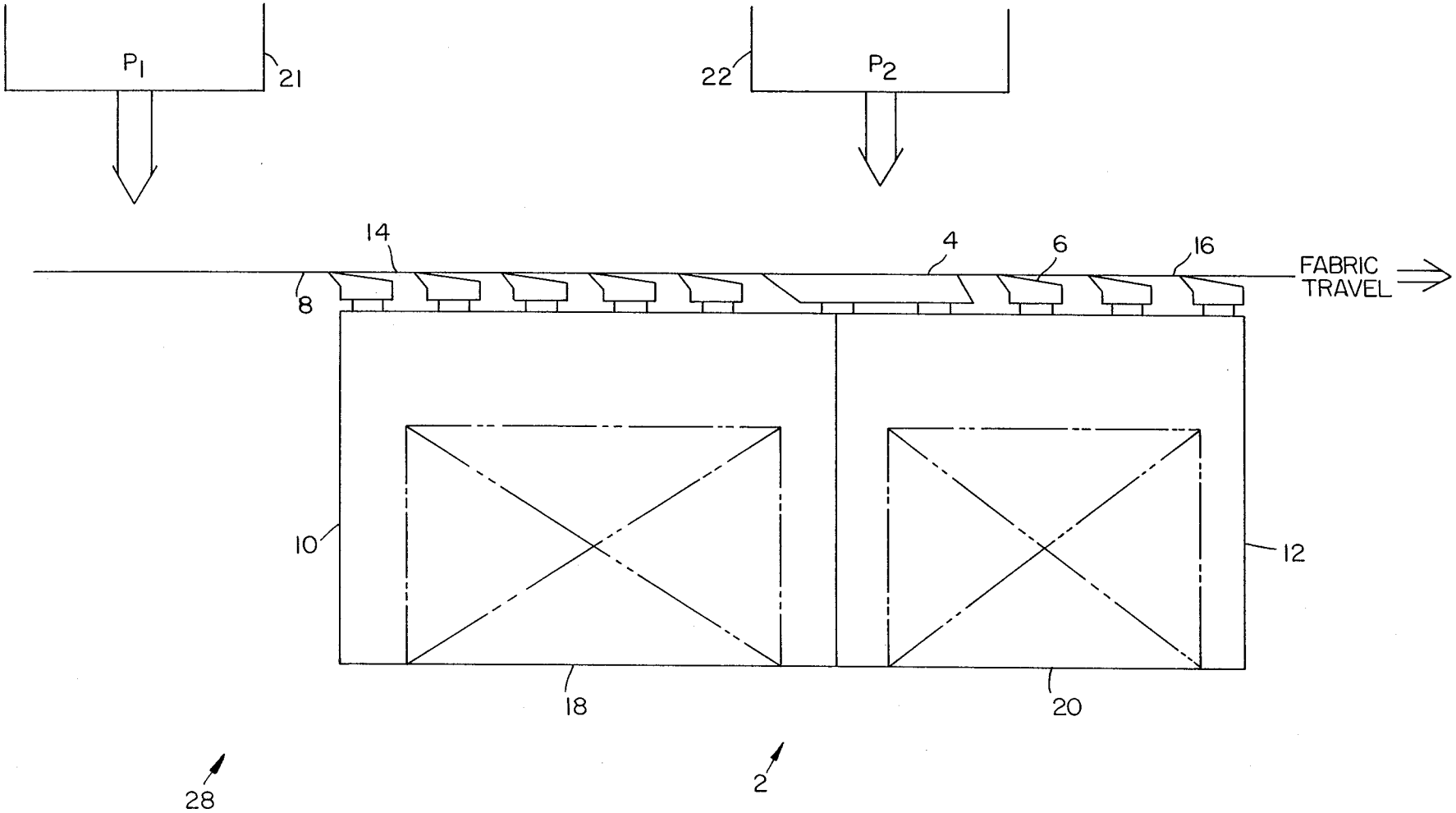
FABRIC TRAVEL
12
16
6
4
20
P2
22
2
18
14
8
10
21
P1
28

DUAL COMPARTMENT VACUFOIL UNIT TO ELIMINATE SECONDARY HEADBOX CHATTER

This is a divisional of co-pending application Ser. No. 116,402 filed on Nov. 3, 1987.

BACKGROUND OF THE INVENTION

The present invention relates to suction boxes in the forming section of a papermaking machine, or more specifically to a dual compartment vacufoil unit at the secondary headbox.

Generally, in the forming section of papermaking machines, a primary headbox discharges paper pulp on a fast-moving papermaking fabric and water is drawn out of the pulp through the fabric to set up the initial paper sheet. The paper sheet travels on the fabric through a series of table rolls or foils, which remove water through the hydrofoil effect, and then passes over suction boxes, which function to remove water from the paper sheet by utilizing a vacuum pump to obtain a pressure differential between the top and bottom surfaces of the forming paper sheet. The pressure differential draws water through the fabric into the suction box and holds the paper sheet tightly against the fabric and the fabric tightly against the suction box surface. Vacuum augmented foils, or vacufoils, may be used to remove water after the conventional hydrofoils and prior to the suction boxes in the papermaking process. Vacufoils remove water from the paper sheet through a combination of the hydrofoil effect and a pressure differential.

A secondary discharge process is required to produce linerboard grade or other multi-layer paper. To produce multi-layer papers, the secondary headbox discharges a secondary delivery of pulp onto the primary paper sheet as it is transported on the papermaking fabric. In various methods, the discharge occurs as the fabric travels over hydrofoils, single compartment vacufoils, suction boxes, or the free span between these dewatering elements.

The second discharge process is not without an important processing problem. Boundary air carried on the dry primary sheet is believed to cause a wind tunnel effect in the converging geometry of the secondary discharge. Boundary air is the air carried on the surface of the primary sheet which becomes trapped when the secondary discharge converges on the primary sheet. If the secondary discharge lands on the primary sheet as the papermaking fabric partly traverses a solid element, for example, a solid dewatering element box cover, and as the fabric partly traverses an open surface, for example, a slot in a dewatering element box cover, both water and boundary air are forced into the same space between the primary sheet and the secondary layer. As both water and boundary air are forced into the same space, a high speed frequency vibration results. The high speed frequency vibration is believed to cause surface defects, known as chattering, chopping, or barring on linerboard grade or other multi-layer paper in the cross-machine direction.

None of the methods discussed above have proven successful in eliminating the chattering, chopping, or barring problem. One method used to eliminate the problem has been to decrease the sheet consistency ahead of the secondary discharge by shutting off the vacuum pump, thereby allowing more water to remain in the sheet. While shutting off the vacuum pump cures the problem, it results in a wetter paper sheet at the rolls further down the processing line. A wetter paper sheet is more susceptible to damage during the rolling process, therefore production speed must be reduced to avoid damage to the paper sheet.

Deliberately wetting the primary sheet may reduce the chattering, chopping and barring problem, but wetting seals off the airspace through the primary sheet. Sealing off the airspace causes the boundary air to be evacuated from the sides of the paper sheet and not through the primary sheet, as desired for a smooth, consistent multi-layer paper sheet. Evacuating air from the sides of the paper sheet causes further defects on the paper surface. Additionally, a reduced fabric speed is required to process a wetter paper sheet, since a wetter sheet is more susceptible to damage during further processing. Accordingly, there is still a need for a device or method to eliminate these problems.

Accordingly, it is an object of the present invention to provide a vacufoil unit for use in forming linerboard grade or other multi-layer paper.

It is a further object of the present invention to eliminate secondary headbox chatter in the production of multi-layer paper without reducing processing speed.

It is a further object of the present invention to eliminate secondary headbox chatter in the production of multi-layer paper without wetting up the primary sheet.

Still another object of the present invention is to provide a method to produce multi-layer paper free from surface defects.

SUMMARY OF THE INVENTION

These and other objects of the present invention are met by providing in a papermaking machine a forming section having an upstream primary headbox, a downstream secondary headbox, and a dual compartment vacufoil unit including a forming blade located beneath the secondary headbox and a method of using the same. In a preferred embodiment, boundary air is evacuated through the primary sheet immediately prior to the secondary headbox discharge. When the secondary headbox delivery is discharged, it contacts the primary paper sheet in an area entirely supported by the solid forming blade, and no high speed vibration exists to cause chopping, charring or barring.

The present invention will be further described in reference to the attached drawing.

BRIEF DESCRIPTION OF THE DRAWING

The FIGURE is a cross-sectional view of the dual compartment vacufoil unit of the present invention.

DETAILED DESCRIPTION OF THE INVENTION

The dual compartment vacufoil of the present invention 2 as shown in the figure comprises dual vacuum compartments 10 and 12, a plurality of foils 6, and a forming blade 4. The forming blade 4 is constructed of conventional material. The forming blade 4 is positioned directly below a secondary headbox 22 which delivers the secondary pulp $P_2$ required for the formation of linerboard grade or other multi-layer paper. The dual compartment vacufoil 2 is located in the forming section 28 of a papermaking machine (not shown). The forming section 28 also includes a primary headbox 21 located upstream from the vacufoil 2.

The foils 6 are placed along the top of the dual vacuum compartments 10 and 12 and are located both upstream and downstream of the forming blade 4. The foils 6 may be conventional hydrofoils of a design such as disclosed in U.S. Pat. No. 3,738,911, to Kienzl et al for hydrofoils, or may be vacuum augmented such as the vacufoil disclosed in U.S. Pat. No. 3,342,385, to B. Thorp. The applicable teachings of these patents are incorporated herein by reference.

In operation, the primary headbox 21 discharges primary pulp $P_1$ onto the papermaking fabric 8 to form the primary paper sheet 14. The fabric 8 supporting the primary paper sheet 14 travels across the hydrofoils 6 and the forming blade 4 in the direction of the arrow in the figure as it approaches the secondary headbox delivery $P_2$. The secondary delivery $P_2$ contacts the primary sheet 14 while the primary sheet 14 is on the fabric 8 supported by the forming blade 4, preventing the force of the delivery P from vibrating the primary sheet 14 and the fabric 8.

The dual compartment vacufoil unit 2 includes two compartments, an upstream compartment 10 and a downstream compartment 12. Each compartment is conventionally constructed and supplied with a pressure differential shown by the dotted structures 18 and 20. For example, the compartments 10 and 12 of the present invention are produced according to United States Patent No. 3,432,385 to B. Thorp, which discloses a pressure differential source for vacufoil units, and the applicable teachings of that patent are incorporated herein by reference. The pressure differentials maintained upstream and downstream may differ such that either may exert a greater vacuum than the other on the paper sheet.

The upstream compartment 10 is located beneath the upstream end of the forming blade 4, and includes means for providing a pressure differential under the primary sheet 14. The upstream compartment 10 evacuates boundary air through the primary sheet 14 immediately prior to the secondary discharge P contacting the primary sheet 14. This evacuation of boundary air functions to eliminate the high frequency vibration that occurs in multi-layer paper processing of the prior art.

The downstream vacuum compartment 12 is located beneath the downstream end of the forming blade 4. The downstream vacuum compartment 12 includes means for providing a pressure differential beneath the multi-layer paper sheet 16, formed by the secondary pulp discharge P on the primary sheet 14. This pressure differential removes water from the multi-layer paper sheet 16 and provides vertical motion of the fabric 7 and multi-layer paper sheet 16 between the hydrofoils 6. This vertical motion is necessary to ensure consistent distribution of the secondary discharge pulp $P_2$ on the primary sheet 14.

The combination of the forming blade 4 located directly beneath the secondary pulp discharge $P_2$, ensuring that the papermaking fabric 7 is contacting a solid element when the discharge $P_2$ strikes, and that the dual compartment vacufoil unit 2 located beneath the forming blade 4 prevents vibration from disturbing the distribution of the secondary discharge P on the primary sheet 14. Eliminating vibration results in the formation of a multi-layer paper sheet that does not suffer surface inconsistencies such as chattering, chopping and barring, and that has a consistent distribution of secondary pulp fibers in its secondary layer.

The embodiments and methods which have been described herein are but some of the several which utilize this invention and are are set forth here for illustration but not for limitation. It is apparent that many other embodiments which will be readily apparent to those skilled in the art may be made without materially departing from the spirit and scope of this invention.

What is claimed is:

1. In a forming section of a papermaking machine used to produce linerboard grade or other multi-layer papers by applying a secondary discharge of pulp onto a primary paper sheet, said forming section including a primary headbox for discharging a primary pulp onto a traveling papermaking fabric to form the primary paper sheet and a secondary headbox for discharging a secondary pulp onto the primary paper sheet on the traveling papermaking fabric downstream in the direction of travel of the papermaking fabric from the primary headbox, a dual compartment vacufoil unit comprising:

a forming blade positioned directly beneath said secondary headbox so as to be positioned directly beneath the secondary pulp discharge;

an upstream vacuum compartment, said upstream vacuum compartment located beneath an upstream portion of said forming blade;

a downstream vacuum compartment, said downstream vacuum compartment located beneath a downstream portion of said forming blade; and means to create pressure differentials in said upstream vacuum compartment and said downstream vacuum compartment, wherein the pressure differential in said upstream vacuum ocmpartment evacuates air and moisture from the primary paper sheet immediately before the secondary discharge of pulp is delivered onto the primary paper sheet and wherein the pressure differential in said downstream vacuum compartment evacuates air and moisture from said primary sheet and the secondary pulp discharge after secondary pulp is discharged onto said primary paper sheet.

2. In a forming section of a papermaking machine used to produce linerboard grade or other multi-layer papers by applying a secondary discharge of pulp onto a primary paper sheet, said forming section including a primary headbox for discharging a primary pulp onto a traveling papermaking fabric to form the primary paper sheet and a secondary headbox for discharging a secondary pulp onto the primary paper sheet on the traveling papermaking fabric downstream in the direction of travel of the papermaking fabric from the primary headbox, a dual compartment vacufoil unit comprising:

a forming blade positioned directly beneath said secondary headbox so as to be positioned directly beneath the secondary pulp discharge;

an upstream compartment, said upstream compartment located beneath an upstream portion of the forming blade;

a downstream vacuum compartment, said downstream vacuum compartment located benath a downstream portion of said forming blade;

means to create pressure differentials in said upstream vacuum compartment and said downstream vacuum compartment, wherein the pressure differential in said upstream vacuum compartment evacuates air and moisture from the primary paper sheet immediately before the secondary discharge of pulp is delivered onto the primary paper sheet, and wherein the pressure differential in said downstream vacuum compartment evacuates air and moisture from said primary sheet and the secondary pulp discharge after secondary pulp is discharged onto said primary paper sheet; and a plurality of foils located upstream and downstream of said forming blade.

3. A dual compartment vacufoil unit according to claim 1 further comprising a plurality of foils located upstream and downstream of the forming blade.

* * * * *